US005233768A

United States Patent [19]

Humphreys

[11] Patent Number: 5,233,768

[45] Date of Patent: Aug. 10, 1993

[54] MAGNETHERAPY INSOLE FOR SHOES

[76] Inventor: Clinton C. Humphreys, 4926 Indian Springs Ct., Plant City, Fla. 33565

[21] Appl. No.: 988,409

[22] Filed: Dec. 7, 1992

[51] Int. Cl.[5] ..... A43B 13/38; A43B 23/00

[52] U.S. Cl. ..... 36/44; 36/140; 36/141

[58] Field of Search ..... 36/1, 43, 44, 140, 141, 36/98; 5/906

[56] References Cited

U.S. PATENT DOCUMENTS

| | | | |
|---|---|---|---|
| 4,033,054 | 7/1977 | Fukuoka | 36/141 |
| 4,109,661 | 8/1978 | Fukuoka | 36/141 |
| 4,509,219 | 4/1985 | Yagi | 5/906 |
| 4,843,738 | 7/1989 | Masuda | 36/44 |
| 4,850,340 | 7/1989 | Onishi | 128/48 |
| 5,035,017 | 7/1991 | Komuro | 600/9 |
| 5,103,513 | 4/1992 | King | 5/186.1 |
| 5,161,272 | 11/1992 | Yamaguchi et al. | 5/906 |

FOREIGN PATENT DOCUMENTS 3316642 11/1984 Fed. Rep. of Germany ..... 36/44

*Primary Examiner*—Steven N. Meyers
*Assistant Examiner*—M. D. Patterson

[57] ABSTRACT

A magnetherapy insole for a shoe, having a three layer design. A top, cushioning layer for the comfort of the user. A center layer having a distinct pattern of lengthwise strips of material, these lengthwise strips of material being a north pole oriented strip, a dialectric lengthwise strip, and a south pole oriented lengthwise strip. Further, each of these lengthwise magnetic strips are formed of a top layer of north pole oriented material, covering a layer of dialectric material, and then, a bottom layer of south pole oriented material covering the bottom of the dialectric material. These strips of magnetic material are installed alternately in the center layer, creating a pattern of north pole oriented strip, bordering a dialectric strip, bordering a south pole oriented strip. A bottom cushioning layer, having a plurality of protrusions on the bottom, provides additional cushioning effects to the user.

1 Claim, 2 Drawing Sheets

MAGNETHERAPY INSOLE FOR SHOES

BACKGROUND OF INVENTION

This invention relates to an apparatus and method of applying a magnetic therapy to the feet, and legs of a person, while wearing a shoe, consisting of an insole insert for the shoe, and the insole insert having three layers of material, the one of which is a magnet therapy material, and the other two layers being a top cushion, and a bottom cushion.

The art of utilizing magnets for therapeutic purposes is well known, and is an old art. It has even been applied to complete beds, as taught in the art of Komuro, in U.S. Pat. No. 5,035,017, wherein a plurality of permanent magnets are fitted between two fibrous sheets of material, creating a sleeping mat for a person. Certain therapeutic effects are claimed for this device when a person sleeps on the mat. Such a large device would not be applicable for the feet of a person.

Another application for this magnetic effect is taught in the art of Susic, in U.S. Pat. No. 5,084,003, wherein a person is completely surrounded by pulsating magnets, the magnetic effect being a massage effect to the person, and the massage effect produced by a low frequency, low voltage pulse generator. Here again, a certain therapeutic effect is claimed to be produced by the art. This art would certainly not be applicable to an insole for a shoe.

Still another approach to using magnets for therapeutic purposes is taught in the art of King, in U.S. Pat. No. 5,103,513, wherein a cushioned mat, or seat, is taught for use in a truck cab, while one of the drivers is sleeping. In this art, the magnets are arranged as a mat, and keeps the sleeping person suspended in a magnetic shock absorbing effect, while at the same time producing the therapeutic effect to the sleeping person. Again, this device would not be applicable to the feet of a person.

SUMMARY OF THE INVENTION

Accordingly, it is an object of this invention to provide a new and improved magnetherapy device, in the shape and design of an insole, for insertion into the shoe of a person, and the inserted device providing a certain comfort, and magnetherepy, to the person wearing the shoe.

Another object of this invention is to provide this magnetherapy insole in a new and improved design which tends to aid in the circulation of the blood in the feet, and legs of the person using the device.

Another object of this invention is to provide this magnetherapy insole in a new and improved design which tends to polorize the cells in the feet and legs of the person using the device, and this cell polarization tending to increase the affinity of the blood to oxygen, thereby increasing the strength of the person using the device.

It is still another object of this invention to provide this magnetherapy insole in a new and improved design which tends to affect the Ph value of the blood to a more basic solution, and, as there is a relation between Migrain Headaches, and an acidic content of the blood, the invention tends to relieve these Migrain Headaches, even though the magnetherapy insole is worn in the shoe.

In carrying out this invention in the illustrative embodiment thereof, a magnetherapy insole is inserted into each of the shoes of the user, and are left there while the user wears the shoes. The insoles provide the comfort, and the magnetherapy to the user during the wearing of the shoes.

The magnetherapy insoles are designed with three layers of comfort to the user. An upper cushion layer of Trecor type cushion material, formed in the shape of an insole, covers a center layer of a new design for permanent magnets. This design consists of the mating of strips of extended permanent magnets, and these magnets being laid lengthwise the insole, and these strips of magnets having strips of dialectric material separating the magnetic strips in their lengthwise direction of the insole. This design having a strip of magnetic material of a north pole polarization laid lengthwise the insole, bordered on each lengthwise side by a lengthwise strip of dialectric material, and, a strip of magnetic material of a south pole polarization bordering the lengthwise strip of dialectric material, causing a pattern of lengthwise strips of north pole polarized material, bordered by a lengthwise strip of dialectric material, and then, a lengthwise strip of south pole polarized material.

Now, each of the strips of magnetic material are designed with an outer strip of material having been magnetized in a north pole direction, separated from an opposed outer strip of material having been magnetized in a south pole direction, and these two strips being separated by a strip of dialectric material, and this separation of the two strips of magnetic material keeping them from being neutralized by touching each other over a period of time. These strips of magnetic material are laid alternately, north pole, south pole, to form the insole, and as stated, each of the strips are bordered on both sides by a lengthwise strip of dialectric material.

Now, the third layer of the magnetherapy insole is aleo a cushioning material, and, having a plurality of protrusions on the bottom, and these protrusions creating a cushioning, and massaging effect to the feet of the user. These three layers of material forming the complete magnetherapy insole.

Conveniently, the user may insert the invention inside their shoe, one invention inside each shoe, and immediately feel the comfort of the invention, and experience the effects of the permanent magnets on their circulatory system, and the cell polarization, and the effects of an increase in the circulation in their feet, and legs.

BRIEF DESCRIPTION OF THE DRAWINGS

This invention, together with other objects, features, aspects and advantages thereof, will be more clearly understood from the following description, considered in conjunction with the accompanying drawings.

Two sheets of drawings are furnished, sheet one contains FIG. 1, and sheet 2 contains FIG. 2, and FIG. 3.

DESCRIPTION OF THE PREFERRED EMBODIMENTS

Figure 1:
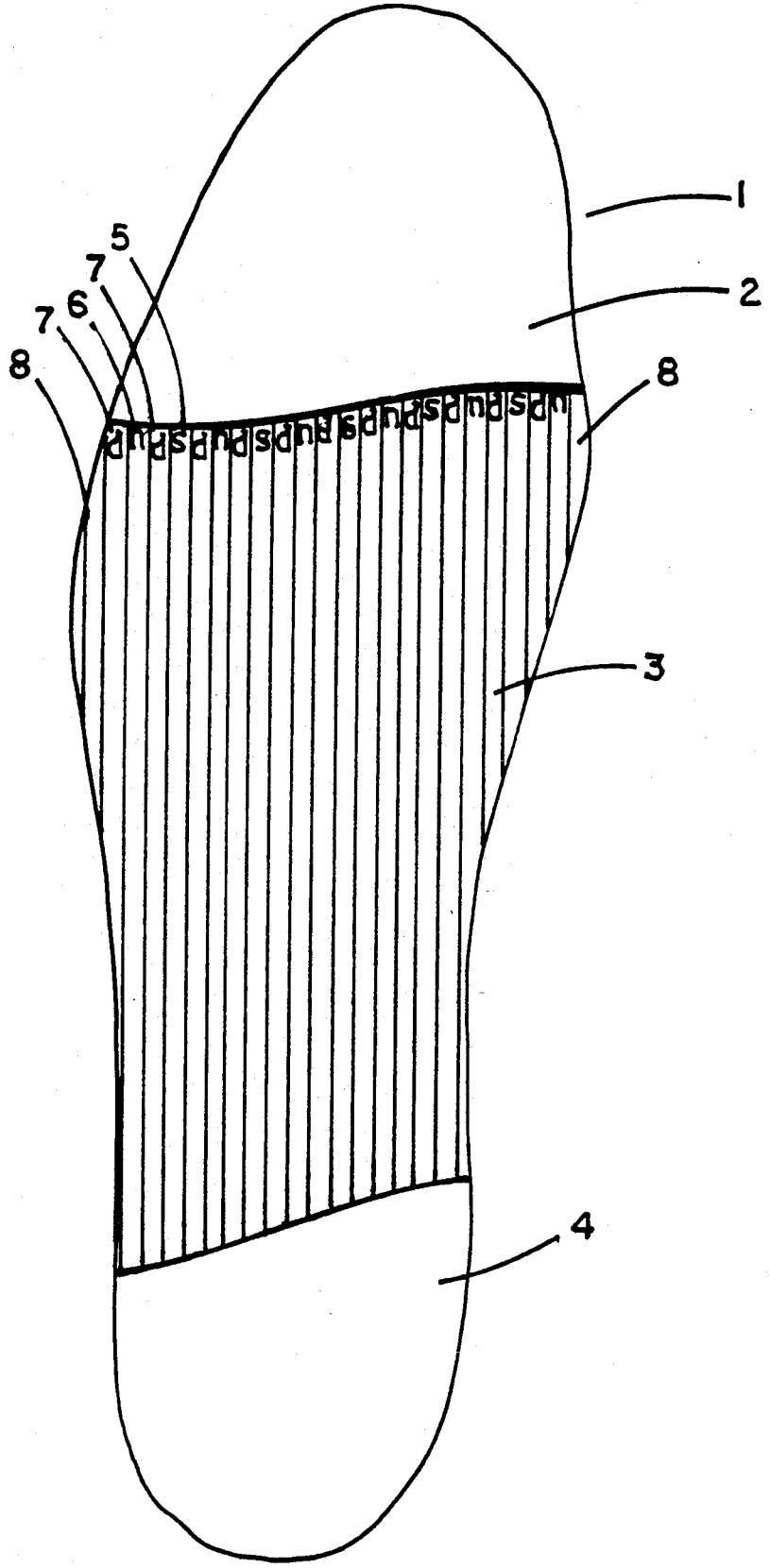
FIG. 1 is a top overlay view of the invention, showing the three layers of material, the top cushion layer, the center permanent magnet layer, and the bottom supporting layer.

Referring now to FIG. 1, a magnetherapy insole, referred to generally by the reference numeral 1 is made to fit either the left foot, or, the right foot, not both feet, and consists of three layers of material. A top layer 2 is a cushion layer for comfort of the user, a center layer 3 is a plurality of permanent lengthwise strips of magnets, of alternating strips of north pole oriented magnets 6 and south pole oriented magnets 5, and these strips of permanent magnets are separated from each other in the lengthwise direction by matching strips of a dialectric material 7.

Figure 2:
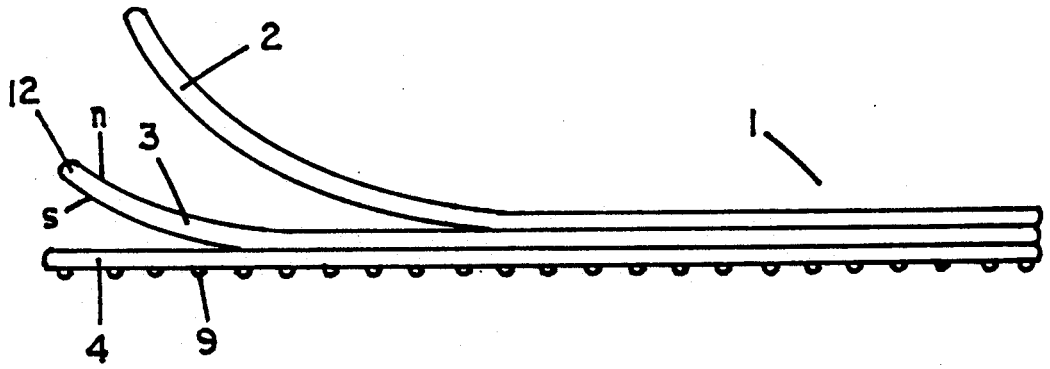
FIG. 2 is a side cutaway view of the invention, showing the three layers of material, and the protrusions on the bottom layer, for added support to the user.

Referring now to FIG. 2, we see a side view of the invention, having the three layers separated for better understanding the invention. We see the top layer 2 covering the center layer 3, and center layer 3 having itself three distinct layers, a top permanent magnet material of north pole orientation n, a center layer of dialectric material 12, and a bottom layer of permanent magnet material of south poles orientation. Now, referring back to FIG. 1 we see that these strips of magnetic material 5, and 6, are alternately dispersed lengthwise the insole, one strip 6, being bordered with a strip of dialectric material 7, and then one strip 5 with the north pole magnetic material bordering this strip of dialectric material 12 on the other side, creating a distinct pattern of lengthwise strips 5, 7, 6, the complete width of insole 1. Now, at the outer edge of these plurality of strips 5, 6, and 7 we see a strip of neutralized, dialectric material 8, thereby completing the pattern of insole 1.

The third layer (4) of the magnetherapy insole is also a cushioning material, and having a plurality of protrusions (9) on the bottom, and these protrusions creating a cushioning, and massaging effect to the feet of the wearer. These three layers of material forming the complete magnetherapy insole.

Figure 3:
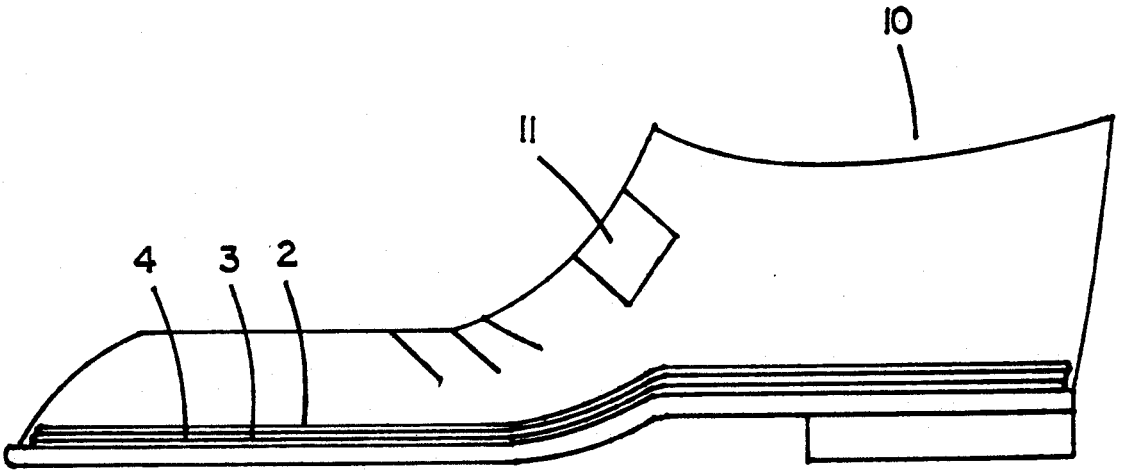
FIG. 3 is a side cutaway view of a shoe, having the invention installed as an insole, and showing the three layers of material.

Referring now to FIG. 3 we see an ordinary shoe 10 having clasping strap 11, and insole 1 installed along its inner sole, Insole 1 having the three layers of material, 2, 3, and 4 the entire length of shoe 10.

Accordingly, a very unique, attractive, convenient method and apparatus are provided for inserting a magnetherapy insole into the inside bottom of a shoe, and this insole providing a massaging, cell polarizing, and circulation therapy to the feet and legs of the user, by means of the strips of magnetic material comprising the center layer of the insole.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A magnetherapy insole for a shoe, for providing the user with a therapeutic and comfortable insole while wearing the shoe, comprising:

an insole shoe insert, said insole having three distinct layers of material, a top cushion layer providing comfort means to the user, a center layer, having lengthwise strips of magnetic material arranged in a distinct pattern of a north pole oriented lengthwise strip of material, bordered by a lengthwise strip of dialectric material, and said lengthwise strip of dialectric material being bordered by a lengthwise strip of south pole oriented material, said north pole oriented strip of material and said south pole oriented material each also having three layers of strip material, and said three layers of strips being a north pole oriented strip of material being affixed laterally, and lengthwise onto one lengthwise side of another matching lengthwise strip of dialectric material, and a matching lengthwise strip of south pole oriented material being affixed laterally onto the other side of said other lengthwise matching strip of dialectric material, thereby creating a three layer strip of permanent magnet material and said three layer strip of magnetic material having a north pole top strip of material, a dialectric center strip of material, and a south pole bottom strip of material, and said three layered strips of material being affixed laterally each other, in an alternate north pole-south pole pattern, and said strips of material being separated each other by a matching lengthwise strip of dialectric material, a bottom layer of material, said bottom layer having a soft, pliable upper surface, said upper surface being affixed under said center layer of permanent magnet material, and said bottom layer of material having a plurality of protrusions on its bottom surface, said protrusions providing additional cushioning means to the user of said insole.

* * * * *